US007214870B2

(12) United States Patent
Klefenz et al.

(10) Patent No.: US 7,214,870 B2
(45) Date of Patent: May 8, 2007

(54) METHOD AND DEVICE FOR GENERATING AN IDENTIFIER FOR AN AUDIO SIGNAL, METHOD AND DEVICE FOR BUILDING AN INSTRUMENT DATABASE AND METHOD AND DEVICE FOR DETERMINING THE TYPE OF AN INSTRUMENT

(75) Inventors: Frank Klefenz, Mannheim (DE); Karlheinz Brandenburg, Erlangen (DE)

(73) Assignee: Fraunhofer-Gesellschaft zur Foerderung der Angewandten Forschung e.v., Munich (DE)

( * ) Notice: Subject to any disclaimer, the term of this patent is extended or adjusted under 35 U.S.C. 154(b) by 356 days.

(21) Appl. No.: 10/496,635

(22) PCT Filed: Nov. 21, 2002

(86) PCT No.: PCT/EP02/13100

§ 371 (c)(1),
(2), (4) Date: May 21, 2004

(87) PCT Pub. No.: WO03/044769

PCT Pub. Date: May 30, 2003

(65) Prior Publication Data

US 2004/0255758 A1 Dec. 23, 2004

(30) Foreign Application Priority Data

Nov. 23, 2001 (DE) ..... 101 57 454

(51) Int. Cl.
*G10H 7/00* (2006.01)

(52) U.S. Cl. ..... 84/603; 84/616

(58) Field of Classification Search ..... 84/603, 84/604, 608, 616
See application file for complete search history.

(56) References Cited

U.S. PATENT DOCUMENTS 3,069,654 A 12/1962 Hough et al. ..... 340/146.3

(Continued)

FOREIGN PATENT DOCUMENTS

EP 690 434 1/1996

(Continued)

OTHER PUBLICATIONS

Kostek, B. et al., Representing Musical Instrument Sounds for Their Automatic Classification; Sep. 2001.

*Primary Examiner*—Jeffrey W Donels
(74) *Attorney, Agent, or Firm*—Michael A. Glenn; Glenn Patent Group

(57) ABSTRACT

In a method for generating an identifier for an audio signal including a tone generated by an instrument, a discrete amplitude-time representation of the audio signal is generated at first, wherein the amplitude-time representation, for a plurality of subsequent points in time, comprises a plurality of subsequent amplitude values, wherein a point in time is associated to each amplitude value. Subsequently, an identifier for the audio signal is extracted from the amplitude-time representation. An instrument database is formed from several identifiers for several audio signals including tones of several instruments. By means of a test identifier for an audio signal having been produced by an unknown instrument, the type of the test instrument is determined using the instrument database. A precise instrument identification can be obtained by using the amplitude-time representation of a tone produced by an instrument for identifying a musical instrument.

23 Claims, 5 Drawing Sheets

U.S. PATENT DOCUMENTS

| | | | | |
|---|---|---|---|---|
| 5,712,953 | A | 1/1998 | Langs | 395/2.23 |
| 5,814,750 | A | 9/1998 | Wang et al. | 84/602 |
| 5,872,727 | A | 2/1999 | Kuo | 364/724.1 |
| 6,124,542 | A | 9/2000 | Wang | 84/603 |
| 6,124,544 | A | 9/2000 | Alexander et al. | 84/616 |
| 6,545,209 | B1 * | 4/2003 | Flannery et al. | 84/609 |
| 6,930,236 | B2 * | 8/2005 | Jung | 84/616 |
| 7,035,742 | B2 * | 4/2006 | Klefenz et al. | 702/66 |
| 2002/0189427 | A1 * | 12/2002 | Pachet | 84/609 |
| 2004/0074378 | A1 * | 4/2004 | Allamanche et al. | 84/616 |

FOREIGN PATENT DOCUMENTS

| | | |
|---|---|---|
| WO | WO 01/04870 | 1/2001 |

* cited by examiner polynomial fit for a flute played vibrato

METHOD AND DEVICE FOR GENERATING AN IDENTIFIER FOR AN AUDIO SIGNAL, METHOD AND DEVICE FOR BUILDING AN INSTRUMENT DATABASE AND METHOD AND DEVICE FOR DETERMINING THE TYPE OF AN INSTRUMENT

CROSS-REFERENCE TO RELATED APPLICATION

This application is a continuation of copending International Application No. PCT/EP02/13100, filed Nov. 21, 2002, which designated the United States and was not published in English.

BACKGROUND OF THE INVENTION

1. Field of the Invention

The present invention relates to audio signals and, in particular, to the acoustic identification of musical instruments the tones of which occur in the audio signal.

2. Description of the Related Art

When making usable widely used music databases for investigations, there is often the desire to determine which musical instrument a tone contained in an audio signal has been produced by. Thus, there might, for example, be the desire to search a music database to find out those pieces from the music database in which, for example, a trumpet or an alto saxophone occur.

Well-known methods for identifying musical instruments are based on frequency evaluations. Here, the different musical instruments are classified according to their overtones (harmonics) or according to their specific overtone spectra. Such a method can be found in B. Kostek, A. Czyzewski, "Representing Musical Instrument Sounds for Their Automatic Classification", J. Audio Eng. Soc., Vol. 49, No. 9, September 2001.

Methods for identifying musical instruments basing on a frequency representation to identify musical instruments have the disadvantage that many musical instruments cannot be identified since the characteristic spectrum generated by a musical instrument might be a "fingerprint" of a musical instrument which is of too little distinctiveness.

SUMMARY OF THE INVENTION

It is the object of the present invention to provide a concept enabling a more precise identification of musical instruments.

In accordance with a first aspect, the present invention provides a method for generating an identifier for an audio signal present as a sequence of samples and including a tone produced by an instrument, having the following steps: generating a discrete amplitude-time representation of the audio signal by detecting signal edges in the sequence of samples, wherein an amplitude value indicating an amplitude of the detected signal edge and a time value indicating a point in time of an occurrence of the signal edge in the audio signal are associated to each detected signal edge, and wherein the amplitude-time representation has a sequence of subsequent signal edges detected; and extracting the identifier for the audio signal from the amplitude-time representation.

In accordance with a second aspect, the present invention provides a method for building an instrument database, having the following steps: providing an audio signal including a tone of a first one of a plurality of instruments; generating a first identifier for the first audio signal according to claim 1; providing a second audio signal including a tone of a second one of a plurality of instruments; generating a second identifier for the second audio signal according to claim 1; and storing the first identifier as a first reference identifier and the second identifier as a second reference identifier in the instrument database in association to a reference to the first and second instruments, respectively.

In accordance with a third aspect, the present invention provides a method for determining the type of an instrument from which a tone contained in a test audio signal comes, having the following steps: generating a test identifier for the test audio signal according to claim 1; comparing the test identifier to a plurality of reference identifiers in an instrument database, wherein the instrument database is generated according to claim 15; and establishing that the type of the instrument from which the tone contained in the test audio signal comes equals the type of the instrument to which a reference identifier which is similar to the test identifier as regards a predetermined criterion of similarity is associated.

In accordance with a fourth aspect, the present invention provides a device for generating an identifier for an audio signal present as a sequence of samples and including a tone produced by an instrument, having: means for generating a discrete amplitude-time representation of the audio signal by detecting signal edges in the sequence of samples, wherein an amplitude value indicating an amplitude of the detected signal edge and a time value indicating a point in time of an occurrence of the signal edge in the audio signal are associated to each detected signal edge, and wherein the amplitude-time representation has a sequence of subsequent signal edges detected; and means for extracting the identifier for the audio signal from the amplitude-time representation.

In accordance with a fifth aspect, the present invention provides a device for building an instrument database, having: means for providing an audio signal including a tone of a first one of a plurality of instruments; means for generating a first identifier for the first audio signal according to claim 21; means for providing a second audio signal including a tone of a second one of a plurality of instruments; means for generating a second identifier for the second audio signal according to claim 21; and means for storing the first identifier as a first reference identifier and the second identifier as a second reference identifier in the instrument database in association to a reference to the first and second instruments, respectively.

In accordance with a sixth aspect, the present invention provides a device for determining the type of an instrument from which a tone contained in a test audio signal comes, having: means for generating a test identifier for the test audio signal according to claim 21; means for comparing the test identifier to a plurality of reference identifiers in an instrument database, wherein the instrument database is formed according to claim 22; and means for establishing that the type of the instrument from which the tone contained in the test audio signal comes equals the type of the instrument to which a reference identifier which is similar to the test identifier as regards the predetermined criterion of similarity is associated.

The present invention is based on the finding that the amplitude-time representation of a tone generated by an instrument is a considerably more expressive fingerprint than the overtone spectrum of an instrument. According to the invention, an identifier of an audio signal including a tone produced by an instrument is thus extracted from an amplitude-time representation of the audio signal. The amplitude-time representation of the audio signal is a discrete representation, wherein the amplitude-time representation, for a plurality of successive points in time, comprises a plurality of successive amplitude values or "samples", wherein a point in time is associated to each amplitude value.

When an instrument database is built with the identifier basing on the amplitude-time representation of the audio signal, wherein an instrument type is associated to each identifier, the identifiers can be employed in the instrument database as reference identifiers for identifying musical instruments. For this, a test audio signal including a tone of an instrument the type of which is to be determined is processed to obtain a test identifier for the test audio signal. The test identifier is compared to the reference identifiers in the database. If a predetermined criterion of similarity between a test identifier and at least one reference identifier is met, the statement can be made that the instrument of which the test audio signal comes is of that instrument type from which the reference identifier comes which meets the predetermined criterion of similarity.

In a preferred embodiment of the present invention, the identifier, be it a test or a reference identifier, is extracted from the amplitude-time representation in such a way that a polynomial is fitted to the amplitude-time representation, wherein the polynomial coefficients $a_{ik}$ (i=1, . . . , n) of the resulting polynomial k span an n-dimensional vector space representing the identifier for the audio signal. Thus, a distance metric, by means of which a so-called nearest neighbor search of the form $\min_i \{a_{0i}-a_{0ref}, \ldots, (a_{ni}-a_{nref})\}$ can be performed, can be introduced favorably.

In a preferred alternative embodiment of the present invention, no polynomial fitting is used but the population numbers of the discrete amplitude lines in a time window are calculated and used to determine an identifier for the audio signal or for the musical instrument from which the audio signal comes.

In general, a compromise between the amount of data of the identifier and specificity or distinctiveness of the identifier for a musical instrument type is to be strived for. Thus, an identifier with a large data contents usually has a better distinctiveness or is a more specific fingerprint for an instrument, due to the great data contents, however, entails problems when evaluating the database. On the other hand, an identifier with a smaller data contents has the tendency to be of smaller distinctiveness, but enables a considerably more efficient and faster processing in an instrument database. Depending on the case of application, an inherent compromise between the amount of data of the identifier and distinctiveness of the identifier is to be strived for.

The same applies to the type of the design of the instrument database. It is up to the user to build very elaborate databases including, for an arbitrarily large number of instruments, an arbitrarily large number of tones and—as an optimum—each tone of the tone range producible by an individual instrument. More elaborate databases may even include inherent identifiers for every tone, however having a difference length, i.e. as a full, half, quarter, eighth, sixteenth or thirty-second note. Other even more elaborate databases may also include identifiers for different techniques of playing, such as, for example, vibrato, etc.

It is an advantage of the present invention that the amplitude curve of a tone played by an instrument includes a very high special character for every instrument so that a signal identifier basing on the amplitude-time representation has a high distinctiveness with a justifiable amount of data. In addition, basically all the tones of musical instruments can be classified into four phases, i.e. the attack phase, the decay phase, the sustain phase and the release phase. This makes it possible, in particular when polynomial fits are used, to classify or divide the polynomials into these four phases. Only for the sake of clarity, a piano tone, for example, has a very short attack phase, followed by an also very short decay phase, which is followed by a relatively long sustain phase and release phase (when the pedal of the piano is pressed). In contrast, a wind instrument, typically also has a very short attack phase, followed by, depending on the length of the tone played, a longer sustain phase, terminated by a very short release phase. Similar characteristic amplitude curves can be derived for a plurality of different instrument types and are expressed either directly in a fitted polynomial or "blurred" via a time window in the population numbers for discrete amplitude lines.

BRIEF DESCRIPTION OF THE DRAWINGS

Preferred embodiments of the present invention will be detailed subsequently referring to the appended drawings, in which.

DESCRIPTION OF THE PREFERRED EMBODIMENTS

Figure 1:
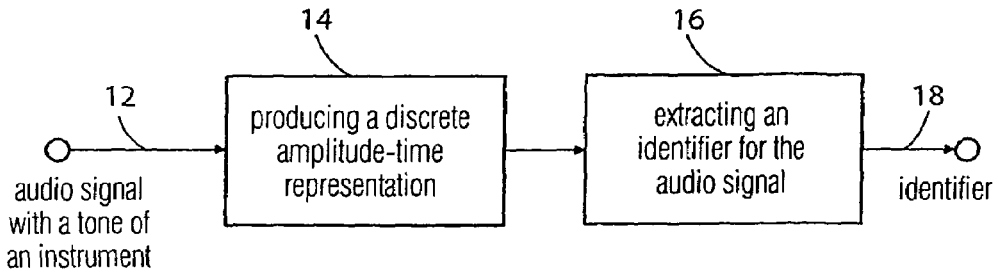
FIG. 1 is a block diagram illustration of the inventive concept for generating an identifier for an audio signal.

FIG. 1 shows a block circuit diagram of a device or a method for generating an identifier for an audio signal. An audio signal including a tone played by an instrument is at an input 12 of the device. This discrete amplitude-time representation is produced from the audio signal by means 14 for producing a discrete amplitude-time representation. The identifier for the audio signal, with the help of which, as will be detailed later, identifying a musical instrument is possible, is then output from this amplitude-time representation of the audio signal at an output 18 by means 16.

For identifying musical instruments, the tone field specifically and characteristically emitted by a musical instrument is preferably converted into an audio PCM signal sequence. The signal sequence, according to the invention, is then transferred into an amplitude/time tuple space and, preferably, into a frequency/time tuple space. Several representations or identifiers which are compared to stored representations or identifiers in a musical instrument database, are formed from the amplitude/time tuple distribution and the (optional) frequency/time tuple distribution. For this, musical instruments are identified with high precision with the help of their specific characteristic amplitude characteristics.

The Hough transformation is preferably used for generating a discrete amplitude/time representation. The Hough transformation is described in the U.S. Pat. No. 3,069,654 by Paul V. C. Hough. The Hough transformation serves for identifying complex structures and, in particular, for automatically identifying complex lines in photographies and other picture illustrations. In its application according to the present invention, the Hough transformation is used to extract signal edges with specified time lengths from the time signal. A signal edge is at first specified by its time length. In the ideal case of a sine wave, a signal edge would be defined by the rising edge of the sine function from 0 to 90°. Alternatively, the signal edge could also be specified by the rise of the sine function from −90° to +90°.

If the time signal is present as a sequence of time samples, the time length of a signal edge, taking the sampling frequency with which the samples have been produced into account, corresponds to a certain number of samples. The length of a signal edge can thus be specified easily by indicating the number of samples the signal edge is to include.

In addition, it is preferred to only detect a signal edge as a signal edge if it is continuous and has a monotonous curve, that is, in the case of a positive signal edge, has a monotonously rising curve. Negative signal edges, i.e. monotonously falling signal edges, could, of course, also be detected.

A further criterion for classifying signal edges is to only detect a signal edge as a signal edge if it covers a certain level area. To fade out noise disturbances, it is preferred to predetermine a minimum level area or amplitude area for a signal edge, wherein monotonously rising signal edges below this area are not detected as signal edges.

Expressed differentially, the Hough transformation is employed as follows. For each pair of values $y_i$, $t_i$, of the audio signal, the Hough transformation is performed according to the following rule:

$$1/A=1/y_i*\sin(\omega_c t_i-\phi).$$

Thus, a sine function having a fixed frequency $\omega_c$ referred to as the center frequency and a different amplitude A which depends on the amplitude value $y_i$ of the current data point is obtained for each data point (yi, ti). The above function is calculated for angles of 0 to $\pi/2$ and the amplitude values obtained for each angle are marked into a histogram in which the respective bin is increased by 1. The starting value of all the bins is 0. Due to the feature of the Hough transformation, there are bins with many entries and few entries, respectively. Bins with several entries suggest a signal edge. For detecting signal edges, these bins must be searched for.

According to the rule, the graph 1/A (phi) is plotted for each pair of values $y_i$, $t_i$ in the (1/A, phi) space. The (1/A, phi) space is formed of a discrete rectangular raster of histogram bins. Since the (1/A, phi) space is rastered into bins in both 1/A and in phi, the graph is plotted in the discrete representation by incrementing those bins covered by the graph by 1.

If several graphs intersect in a bin due to the Hough transformation rule, accumulation points result and a 2D histogram forms wherein high histogram entries in the bin indicate that a signal edge has been present at a time t with the amplitude A, wherein the amplitude is calculated from the amplitude index of the bin and the time of occurrence from the time index of the bin. The local maximum is searched from the histogram in an n×m neighboring environment and the indices of the local maximum found, after converting into the continuous space (A, phi), indicate the amplitude A and the point of occurrence t. These values are plotted in the examples as Ai(ti) tuples.

A numerical example of the signal edge detected described in general before will now be given. Typically, an audio signal is in a sequence of samples which is based on a sample frequency of, for example, 44.1 kHz. The individual samples thus have a time interval of 22.68 μs.

In a preferred embodiment of the present invention, the center frequency for the defining equation mentioned before is set to 261 Hz. This frequency $f_c$ always remains the same. The period of this center frequency $f_c$ is 3.83 ms. Thus, the ratio of the period duration given by the center frequency $f_c$ and the period duration given by the sample frequency of the audio signal, is 168.95.

When the previous defining equation for detecting signal edges according to a preferred embodiment of the invention is considered, the result is that 168.95 phase values are passed for the previously mentioned number values when the phase $\phi$ is incremented from 0 to 2 $\pi$.

As has been explained hereinbefore, no complete sign wave, but only signal edges extending from, for example, 0 to $\pi/2$, are searched by the defining equation. A signal edge here corresponds to a quarter wave of the sine, wherein about 42 discrete phase values or phase bins are calculated for each sample $y_i$ at a point in time $t_i$. The phase progress from one discrete phase value or bin to the next here is about 2.143 degrees or 0.0374.

In detail, the signal edge detection takes places as follows. The first sample of the sequence of samples is started with. The value $y_i$ of the first sample, at the time $t_1$, together with the time $t_1$, is inserted into the defining equation. Then, the phase $\phi$ is passed from 0 to $\phi/2$ using the increment phase described above so that 42 pairs of values result for the first sample in the (1/a, $\phi$) space. Subsequently, the next sample and the time ($y_2$, $t_2$) associated thereto are taken, inserted into the defining equation to increment the phase $\phi$ again from 0 to $\pi/2$ so that, in turn, 42 new values result in the (1/a, $\phi$) space which are, however, offset in relation to the first 42 values in a positive $\phi$ direction by a $\phi$ value. This is performed for all the samples considered one by one, wherein, for each new sample, the 1/a-$\phi$ tuples obtained are entered into the (1/a, $\phi$) space increased by a $\phi$ increment. Thus, the two dimensional histogram results in that, after an entry phase typically applying to the first 42 $\phi$ values in the (1/a, $\phi$) space, a maximum of 42 1/a values are associated to each $\phi$ value.

As has been explained, the (1/a, $\phi$) space is rastered not only in $\phi$ but also in 1/a. For this, preferably 31 1/a bins or raster points are used for rastering. The 42 1/a values associated to each phase value in the (1/a, $\phi$) space, depending on the trajectories calculated by the defining equation, are distributed evenly or unevenly in the (1/a, $\phi$) space. If there is an even distribution, no signal edge will be associated to this $\phi$ value. If, however, an uneven distribution of the histogram entries in one certain 1/a value is associated to a certain $\phi$ value, wherein this value is a local maximum also relative to one or several neighboring $\phi$ values, this will indicate a signal edge having an amplitude equaling the inverse of the 1/a raster point. The time of occurrence directly results from the corresponding $\phi$ value at which the uneven distribution in favor of a certain 1/a bin has taken place. In principle, the point of occurrence can be scaled at will since such a scaling influences all the detected signal edges in the same way.

In a predetermined embodiment of the present invention, it is, however, preferred not to take the first 41 $\phi$ values into consideration and to define the $42^{nd}$ ϕ value as the reference time (t=0). The ϕ value following this reference ϕ value, corresponding to t=0, then indicates a time increment equaling the inverse of the sample frequency on which the audio signal is based, that is ¼44, 1 kHz or 22.68 μs. The second ϕ value after the reference ϕ value then corresponds to a time of 2×22.68 μs or 45.36 μs etc. The, for example, $100^{th}$ ϕ value after the reference ϕ value would then correspond to an absolute time (in relation to the fixed zero time) of 2.268 ms. If the two dimensional histogram in the (1/a, ϕ) space, at this 100th phase value after the reference phase value, had a local maximum regarding an n×m neighboring environment which can be chosen according to requirements, a signal edge defined, on the one hand, by the 1/a bin in which the accumulation is, relative to its amplitude and having the point of occurrence of, for example, 2.268 ms associated to the $100^{th}$ ϕ value after the reference ϕ value would be detected. The amplitude-time diagram of FIG. 5 contains a sequence of signal edges detected in that way in the amplitude-time space corresponding to the (1/a, ϕ) space by the corresponding conversion for the amplitude (inversion) and the time (association of time to space), wherein, however, even here a considerable data reduction takes place in the (1/a, ϕ) space by formatting the local maximum.

It can be seen from the explanation before that the number of signal edges detected from the two-dimensional histogram can be set by choosing the n×m environment for the search of the local maximum differentially. If a large neighboring environment as regards the amplitude quantization and the ϕ quantization is chosen, fewer signal edges result than in the case in which the neighboring environment is selected to be very small. From this, the great scalability feature of the inventive concept can be seen since many signal edges are directly result in a better distinctiveness of the identifier extracted in the end, since, however, the length and storage requirement of this identifier, too, increase. On the other hand, fewer signal edges typically lead to a more compact identifier, wherein a loss in distinctiveness may, however, occur.

Figure 2:
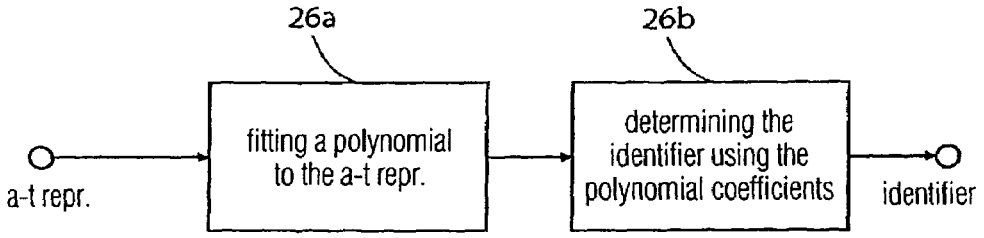
FIG. 2 is a detailed illustration of means for extracting an identifier for the audio signal of FIG. 1 according to an embodiment of the present invention.

FIG. 2 shows a detailed representation of block 16 of FIG. 1, i.e. of the means for extracting an identifier for the audio signal. Departing from the amplitude-time representation, as is illustrated in FIG. 2, a polynomial function is fitted to the amplitude-time representation by means 26*a*. For this, an nth order polynomial is used, wherein the n polynomial coefficients of the resulting polynomial are used by means 26*b* to obtain the identifier for the audio signal. The order n of the fit polynomial is chosen such that the residues of the amplitude-time distribution, for this polynomial order n, become smaller than a predetermined threshold.

Figure 5:
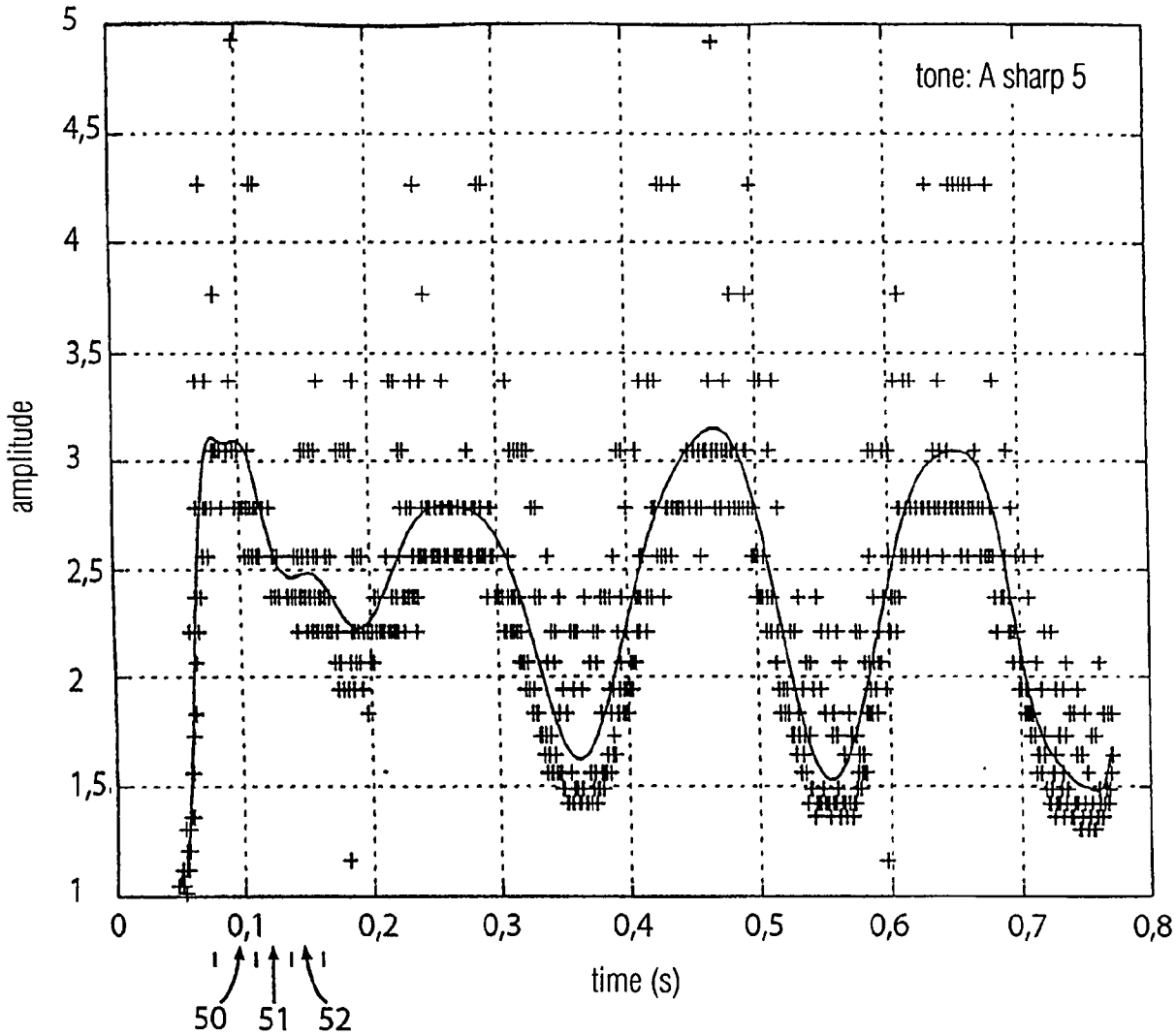
FIG. 5 is an amplitude-time representation of an audio signal with a marked polynomial function, the coefficients of which represent the identifier for the audio signal.

A polynomial with the order 10 has, for example, been used in the example shown in FIG. 5 which includes a polynomial fit for a recorder played vibrato. It can be seen that the polynomial with an order 10 already provides a good fitting to the amplitude-time representation of the audio signal. A polynomial of a smaller order would very probably not follow the amplitude-time representation in such a good way, would, however, be easier to handle as regards the calculation in the database search in database processing for identifying the musical instrument. On the other hand, a polynomial of a higher order than the order 10 would span an even higher n dimensional vector space than the audio signal identifier, which would make the instrument database calculation more complex. The inventive concept is flexible in that differently high polynomial orders can be chosen for different cases of application.

Figure 3:
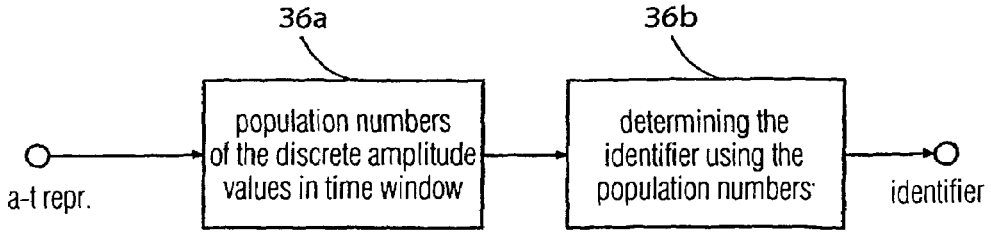
FIG. 3 is a detailed illustration of means for extracting an identifier for the audio signal of FIG. 1 according to another embodiment of the present invention.

FIG. 3 shows a more detailed block circuit diagram of block 16 of FIG. 1 according to another embodiment of the present invention. Here, determining the population numbers of the discrete amplitude values of the amplitude-time representation is performed in a predetermined time window, wherein the identifier for the audio signal, as is illustrated in block 36*b* is determined using the population numbers provided by block 36*a*.

Figure 6:
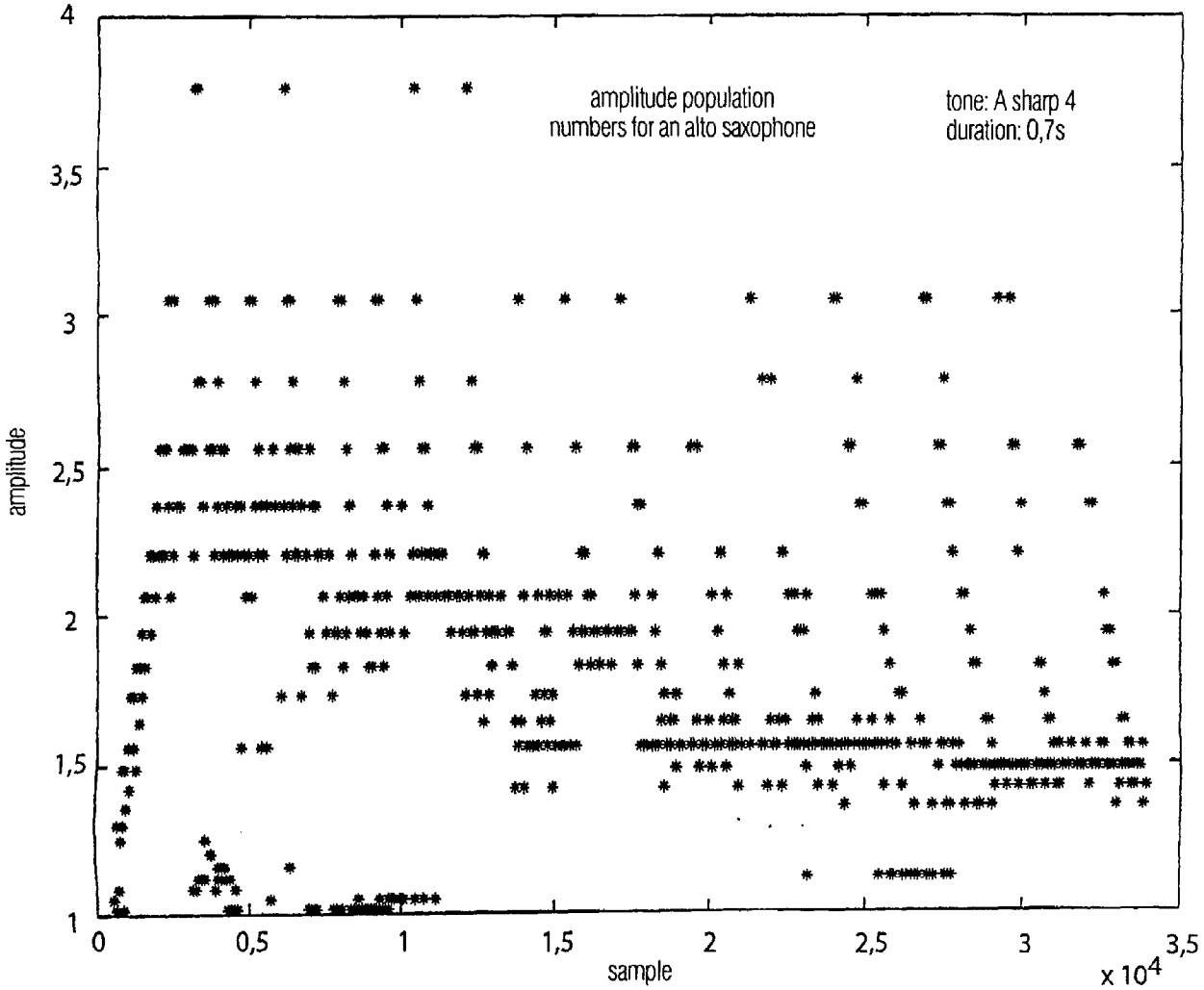
FIG. 6 is an amplitude-time representation of a test audio signal for illustrating the amplitude line population numbers.

An example of this is shown in FIG. 6. FIG. 6 shows an amplitude-time representation for the tone A sharp 4 of an alto saxophone played for a duration of about 0.7 s. It is preferred for the amplitude-time representation to perform an amplitude quantization. In this way, such an amplitude quantization on, for example, 31 discrete amplitude lines results by selecting the bins in the Hough transformation. If the amplitude-time representation is achieved in another way, it is recommended to limit the amount of data for the signal identifier, to perform an amplitude line quantization clearly exceeding the quantization inherent to each digital calculating unit. From the diagram shown in FIG. 6, the number of amplitude values on this line can be obtained easily for each discrete amplitude line (an imagined horizontal line through FIG. 6) by counting. Thus, the population numbers for each amplitude line result.

The amplitude/time tuples, as has been described, due to the transformation method, are on a discrete raster formed by several amplitude steps which can be indicated as amplitude lines in certain amplitude distances as regards one another. How many lines are populated, which lines are populated and the respective population numbers are characteristic for each musical instrument. The population number of each line indicated by the number of amplitude/time tuples having the same amplitude in a time interval of a certain length is counted. These population numbers alone could already be used as a signal identifier. It is, however, preferred to form the population number ratios of the individual lines n0, n1, n2, . . . . These population number ratios n0:n1, n0:n2, n1:n2, . . . are no longer dependent on the absolute amplitude but only provide the relation of the individual amplitude steps as regards one another.

The population number ratios are determined in a window of a predetermined length. By indicating the window length and by dividing the population number ratios by the window length, the population density (number of entries/window length) for each amplitude line is formed. The population density is determined over the entire time axis by a sliding window having a length h and a step width m. The population density numbers are additionally preferably normalized by relating the numbers to the window length and the pitch. In particular in the case wherein the amplitude/time tuples are determined on the basis of a signal edge detection by means of the Hough transformation, the number of amplitude values in a window of a certain length is the higher, the higher the pitch. The population density number normalization to the pitch eliminates this dependency so that normalized population density numbers of different tones can be compared to one another.

In addition, it is preferred to determine the mean value of the amplitude spectrum in the amplitude/time tuple space. The standard deviation of the amplitude spectrum around the mean amplitude is determined by the amplitude/time tuple space. The standard deviation indicates how strong the amplitudes scatter around the mean amplitude. The amplitude standard deviation is a specific measuring number and thus a specific identifier for each musical instrument.

It is also preferred to determine the scattering of the amplitudes around the amplitude standard deviation in the amplitude/time tuple space. The scattering indicates how strong the amplitudes scatter around the amplitude standard deviation. The amplitude scattering is a specific measuring number and thus a specific identifier for each musical instrument.

Figure 4:
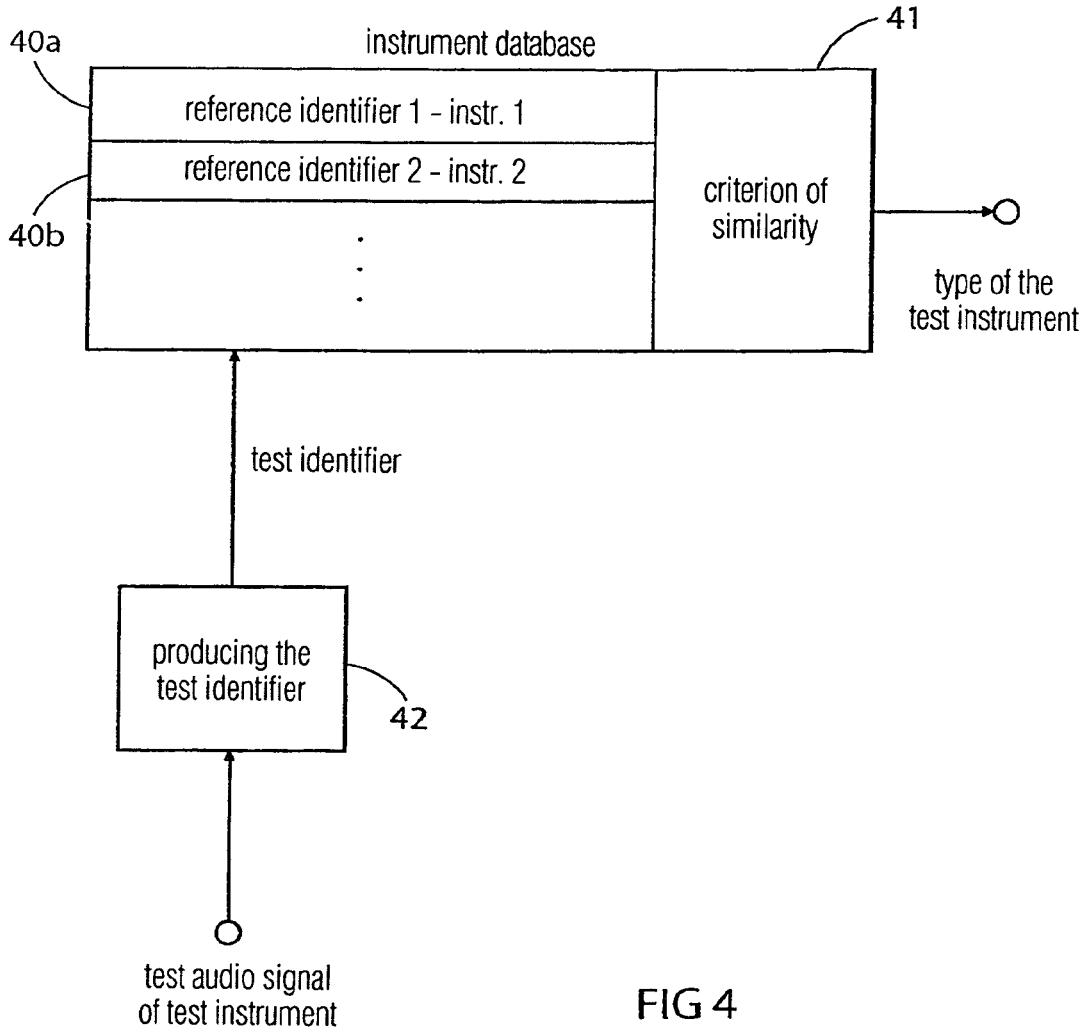
FIG. 4 is a block diagram illustration of a device for determining the type of an instrument according to the present invention.

The procedure described in FIG. 1 to 3 has the result of deriving an identifier which is characteristic for the instrument from which the tone comes, from an audio signal including a tone of an instrument. This identifier can, as is illustrated referring to FIG. 4, be used for different things. At first, different reference identifiers 40*a*, 40*b*, in association to the instrument from which the respective reference identifier comes, can be stored in an instrument database. In order to perform a musical instrument identification, a test identifier is produced by means 42 which has, in principle, the setup is illustrated regarding to FIG. 1 to 3, from a test audio signal from a test instrument. Then, the test identifier is compared to the reference identifiers in the instrument database, for musical instrument identification using different database algorithms known in the art. If a reference identifier which is similar to the test identifier as regards a predetermined criterion of similarity 41 is found in the instrument database, it is determined that the type of the instrument from which the tone contained in the test audio signal comes, equals the type of the instrument to which a reference identifier 40*a*, 40*b* is associated. Thus, the musical instrument from which the tone contained in the test audio signal comes, can be identified with the help of the reference identifiers in the instrument database.

Depending on the complexity to be performed, the instrument database can be designed differently. Basically, the musical instrument database is derived from a collection of tones having been recorded from different musical instruments. A set of tones in half tone steps starting from a lowest tone to a highest tone is recorded for each musical instrument. An amplitude/time tuple space distribution and, optionally, a frequency/time tuple space distribution are formed for each tone of the musical instrument. A set of amplitude/time tuple spaces over the entire tone range of the musical instrument, starting from the lowest tone, in half tone steps, to the highest tone, is generated for each musical instrument. The musical instrument database is formed from all the amplitude/time tuple spaces and frequency/time tuple spaces of the recorded musical instrument stored in the database. In addition, it is preferred to apply several identifiers (polynomial coefficients on the one hand or population density quantities on the other hand or both types together) for each tone of a musical instrument, for a 32nd note, a sixteenth note, an eighth note, a fourth note, a half note and a full note, wherein the note lengths are averaged over the tone duration for each instrument. The set of polynomial curves over the entire tone steps and tone lengths of an instrument represents the musical instrument in the database. In addition, optionally, different techniques of playing are also stored in the music database for a musical instrument by storing the corresponding amplitude/time tuple distributions and frequency/time tuple distributions and determining corresponding identifiers for this and finally filing them in the instrument database. The summarized set of identifiers of the musical instrument for the predetermined notes of the musical instruments and the predetermined note lengths and the techniques of playing together result in the instrument database schematically illustrated in FIG. 4.

For identifying musical instruments, a tone played by a musical instrument unknown at first is transferred into an amplitude/time tuple distribution in the amplitude/time tuple space and (optionally) a frequency/time tuple distribution in the frequency/time tuple space. The pitch of the tone is then preferably determined from the frequency/time tuple space. Subsequently, a database comparison using the reference identifiers referring to the pitch determined for the test audio signal is performed.

The residue to the test identifier is determined for each of the reference identifiers. The residue minimum resulting when comparing all the reference identifiers with the test identifier is taken as an indicator for the presence of the musical instrument represented by the test identifier.

As has been explained, the identifier, in particular in the case of the polynomial coefficients, spans an n dimensional vector space, the n dimensional distance to the n dimensional vector space of a reference identifier is not only calculated qualitatively but also quantitatively. A criterion of similarity might be that the residue, i.e. the n dimensional distance of the test identifier from the reference identifier, is minimal (compared to the other reference identifiers) or that the residue is smaller than a predetermined threshold. Of course, it is also possible to perform a multi-step comparison in such a way that at first the instrument itself and then a tone length and finally a technique of playing are evaluated.

In particular in the embodiment shown in FIG. 2 in which a polynomial fit is performed, it is to be pointed out that the polynomial fit is related to a fixed reference starting point. Thus, the first signal edge of an audio signal is set as the reference starting point of the polynomial curve. To identify a musical instrument from a sequence of tones played legato, the selection of a reference signal edge is not indicated unambiguously. This setting of the reference starting edge for the polynomial curve is performed after a pitch change and the reference starting point is put to the transition between two pitches. If the pitch change cannot be determined, the unknown distribution is "drawn" over the entire set of all the reference identifiers in the instrument database in the general case by always shifting the test identifier by a certain step type with regard to the reference identifier.

As has already been explained, FIG. 5 shows a polynomial fit of a polynomial of the order 10 for a recorder tone played vibrato of the standard work McGills Master Samples Reference CD. The tone is A sharp 5. The distance of the polynomial minima after the settling process directly results in the vibrato, in Hertz, of the instrument. In addition, an attack phase 50, a sustain phase 51 and a release phase 52 are shown with each tone.

It can be seen from FIG. 5 that the attack phase 50 and the release phase 52 are relatively short. In contrast, the release phase of a piano tone would be rather long, whereby the characteristic amplitude profile of a piano tone can be differentiated from the characteristic amplitude profile of a recorder.

Figure 7:
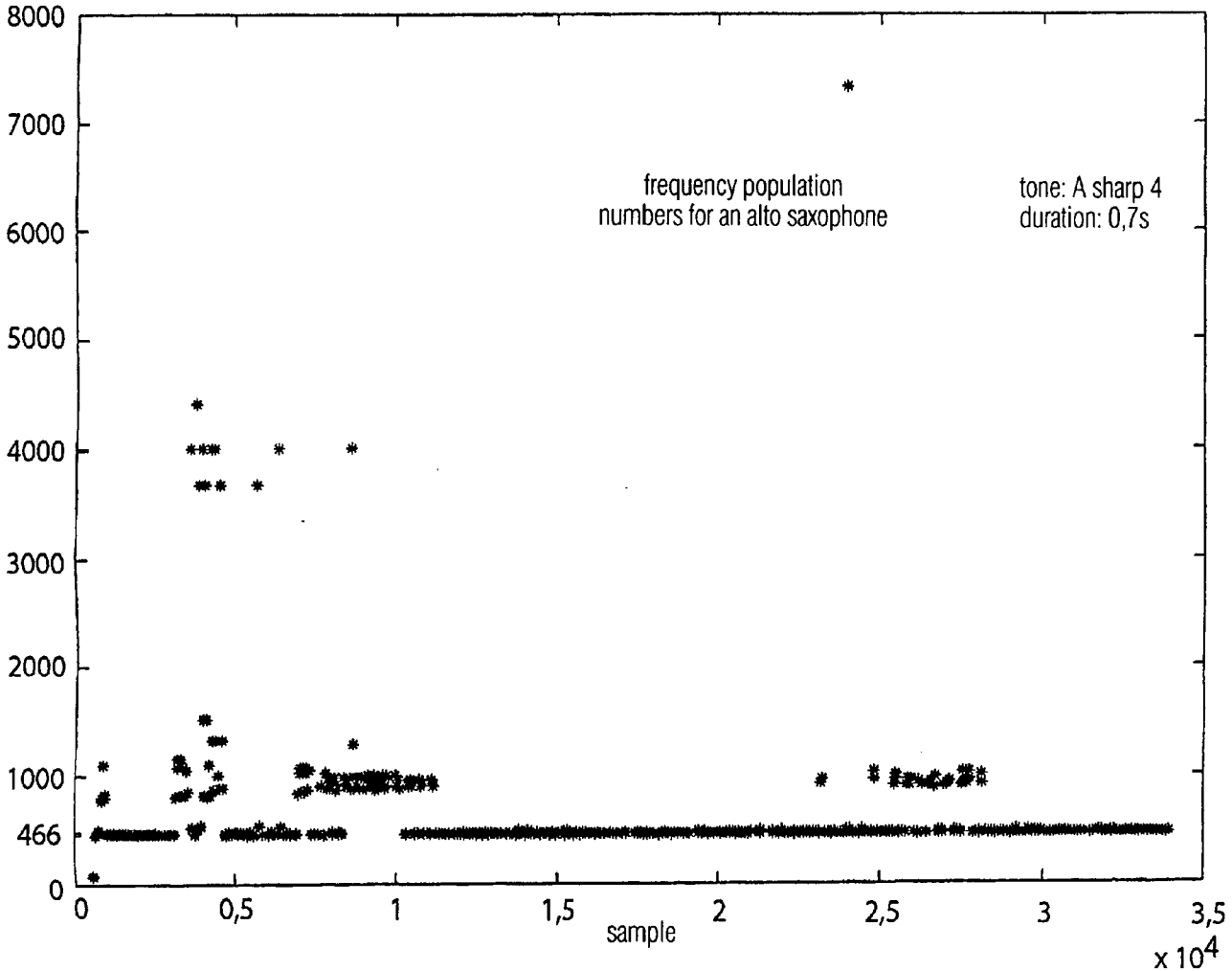
FIG. 7 is a frequency-time representation of an audio signal for illustrating the frequency line population numbers.

As has already been explained, apart from the amplitude-time representation, a frequency-time representation can be used to supplement the music instrument identification. For this, FIG. 7 shows the frequency population numbers for an alto saxophone, i.e. for the tone A sharp 4 (in American notation) played for the duration of 0.7 s, which corresponds to a duration of about 34,000 PCM samples in a recording frequency of 44.1 kHz. The line roughly formed in FIG. 7 shows that the A sharp 4 has been played at 466 Hz. It is to be pointed out that the frequency-time distribution and the amplitude-time distribution of FIGS. 7 and 6 correspond to each other, i.e. represent the same tone.

The frequency-time distribution can also be used to determine the fundamental tone line resulting for each musical instrument, indicating the frequency of the tone played. The fundamental tone line is employed to determine whether the tone is within the tone range producible by the musical instrument and then to select only those representations in the music database for the same pitch.

The frequency-time distribution can thus be used to perform a pitch determination.

The frequency-time distribution can additionally be used to improve the musical instrument identification. For this, the standard deviation around the fundamental tone line in the frequency/time tuple space is determined. The standard deviation indicates how strong the frequency values scatter around the mean frequency. The standard deviation is a specific measuring number for each musical instrument. Bach trumpets and violins, for example, have a high standard deviation.

The scattering around the standard deviation in the frequency/time tuple space is determined. The scattering indicates how strong the frequency values scatter around the standard deviation. The scattering is a specific measuring number for each musical instrument.

The frequency/time tuples, due to the transformation method, are on a discrete raster, formed by several frequency lines in certain frequency distances relative to one another. How many frequencies are populated, which lines are populated, and the respective population number are characteristic for each musical instrument. Many musical instruments comprise characteristic frequency/time tuple distributions. In addition to the fundamental tone line, there are further distinct frequency lines or frequency areas. Violin, oboe, trumpet and saxophone, for example, are instruments having characteristic frequency lines and frequency areas. A frequency spectrum is formed for each tone by counting the population numbers of the frequency lines. The frequency spectrum of the unknown distribution is compared to all the frequency spectra. If the comparison results in a maximum matching, it is assumed that the nearest frequency spectrum represents the musical instrument. The oboe oscillates in two frequency modes so that two frequency lines form in a defined frequency distance. If these two frequency lines are formed, the frequency/time tuple distribution very probably goes back to an oboe. Several musical instruments, above the fundamental tone line in a defined frequency distance, comprise population states in a group of neighboring frequency lines defining a fixed frequency area. The cor anglais cyclically oscillates in a frequency-modulated way between two opposite frequency arches. The cor anglais can be verified by the cyclic frequency modulation.

In the case of a piano, vertical structures caused by the attack behavior of a piano tone occur in the frequency/time tuple space. It is determined with a gliding histogram method whether there are histogram entries in a certain time interval above the fundamental tone line. The number of histogram entries, normalized to a minimum number, is a measure of whether a tone has been produced by a piano.

As has already been mentioned, different musical instruments and, in particular, different tones of musical instruments and even different modes of playing musical instruments have different amplitude-time courses. This feature is employed for the inventive identification of musical instruments. Musical instruments have the typical phases of attack, decay, sustain and release, wherein in some instruments, for example, the decay phase has vanished nearly completely, and wherein in some musical instruments the sustain phase and the release phase may additionally merge into each other.

Subsequently, different amplitude-time representations of musical instruments will be discussed, wherein the audio samples of the McGill Master Series Collection are used. The CD is a sound archive of recorded notes of musical instruments over the entire tone range of an instrument in half tone steps. The respective first 0.7 seconds of a tone have been examined for the subsequent results. According to the invention, the amplitude-time representation is used, wherein a tuple in the amplitude-time representation illustrates the amplitude of a signal edge found at a time t, preferably by the Hough transformation. Optionally, as has already been explained, a frequency-time representation is also used, wherein a tuple in the frequency-time representation indicates the frequency of two subsequent signal edges at the point of occurrence. In addition, also optionally, a frequency-amplitude scattering representation can be used to use further information for an instrument identification.

From an analysis of the tone b5, in American notation, having a frequency of 987.77 Hz, played on a Steinway and hit in a soft way, the typical ADSR amplitude curve for a piano results, that is a steep attack phase and a steep decay phase. In the scattering representation, the amplitude scattering is plotted against the frequency scattering, wherein a dumbbell or lobe form which is also characteristic for the instrument results.

If the same tone b5 is played with a hard hit, a smaller standard deviation results in the frequency plot, wherein the scattering is time-dependent. At the beginning and the end, the scattering is stronger than in the middle. In the amplitude-time representation, the attack phase and the decay phase are expanded to strip bands.

If the tone b4 is played unplugged and undistorted with a frequency of 493 Hz on an electric guitar, the result is a clear frequency fundamental line having a smaller standard deviation than the piano. In the amplitude-time representation, the result is a typical ADSR envelope curve having a very short attack phase and a deep-edged broad decay band.

The tone recording of Violin Natural Harmonics tone b5 987 Hz, in the analysis, results in a greater frequency scattering at the beginning and the end. A broad attack band, a transition to a broad decay band and a new rise into the sustain phase result in the amplitude-time representation, wherein a relatively large scattering results in the scattering representation.

If the tone g6 with a frequency of 1568 Hz is played on a Bach trumpet, the result is a high standard deviation which is time-dependent at the beginning and the end and has an expansion at the end. In the amplitude-time representation, the result is a typical ADSR course having a steep attack phase and a modulated decay phase up and down.

If the tone b3l is played on a bassoon with a frequency of 246 Hz, a low standard deviation results when determining the frequency. The bassoon shows a typical ADSR envelope curve for wind instruments with an attack phase and a transition into the sustain phase and an abrupt end, i.e. an abrupt release phase.

The soprano saxophone, with its tone a5 with a frequency of 880 Hz, shows a small standard deviation. As regards the amplitude-time representation, an immediate transition to the steady state (sustain) can be seen, wherein the population states are time-dependent.

If a piccolo recorder is played with a tone g7 at 3136 Hz, the frequency fundamental tone line can be identified, wherein there are, however, many sub-harmonics. In the amplitude-time representation, an immediate transition into the steady state can be seen, wherein the population state are time-dependent. The scattering representation shows a widely distributed characteristic.

When its tone e3 is played at 164 Hz, the bass trombone shows an unambiguous fundamental frequency line and shows a slow rise to the steady state in the amplitude-time representation.

The bass clarinet, tone c3, 130 Hz, in turn, shows a marked fundamental frequency line and an additional frequency band between 800 and 1200 Hz. In the amplitude-time representation, a steady state with large amplitude variations can be seen. In the scattering representation, marked dumbbells can be seen.

The cor anglais, being part of the family of oboes, when the tone e5 is played with 659 Hz, does not show a marked fundamental frequency line, but a frequency modulation between two frequency modes can be seen. The steady state phase in the amplitude-time representation is time-dependent. Several sub-lines show up in the scattering representation.

The tone C sharp 5, 554 Hz, played by a French horn, shows two frequency lines, whereby an unambiguous fundamental frequency determination is not possible. There is an oscillation between two frequency modes. In the amplitude-time representation, there is a typical attack phase and a typical steady state for wind instruments.

Preferably, the frequency determination is performed before the amplitude-time representation determination to limit the search space in a database since the tone played itself, i.e. the pitch present, is determined before the individual instrument is determined. Then, only the group of entries in the database referring to the certain tone must be searched.

While this invention has been described in terms of several preferred embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

What is claimed is:

1. A method for generating an identifier for an audio signal present as a sequence of samples and including a tone produced by an instrument, comprising the following steps:

providing said audio signal;

generating a discrete amplitude-time representation of the audio signal by detecting signal edges in the sequence of samples, wherein an amplitude value indicating an amplitude of the detected signal edge and a time value indicating a point in time of an occurrence of the signal edge in the audio signal are associated to each detected signal edge, and wherein the amplitude-time representation comprises a sequence of subsequent signal edges detected;

extracting the identifier for the audio signal from the amplitude-time representation; and storing said identifier in a storage medium.

2. The method according to claim 1, wherein rising signal edges in the audio signal are detected in the step of producing.

3. The method according to claim 2, wherein a signal edge includes a sine function with an angle of 0° to an angle of 90°.

4. The method according to claim 3, wherein a Hough transformation is performed in the step of generating.

5. The method according to claim 1, wherein the step of extracting comprises the following step:

fitting a polynomial comprising a number of polynomial coefficients to the amplitude-time representation, wherein the signal identifier is based on the polynomial coefficients.

6. The method according to claim 5, wherein the number of polynomial coefficients determining an order of the polynomial is determined in such a way that a deviation of the amplitude-time representation from the polynomial is smaller than a polynomial function threshold value.

7. The method according to claim 5, wherein a reference starting point of the polynomial is set at a starting point in time at which the associated amplitude exceeds a reference threshold value.

8. The method according to claim 1, wherein the amplitude values of the amplitude-time representations are quantized into a plurality of discrete amplitude lines, and wherein the step of extracting comprises:

for the amplitude lines of the plurality of amplitude lines, determining the number of points in time to which amplitude values are associated which are on a discrete amplitude line, in a predetermined time window to obtain population numbers for the plurality of amplitude lines, wherein the signal identifier is based on the population numbers for the plurality of amplitude lines.

9. The method according to claim 8, wherein population number ratios between the population numbers of the plurality of amplitude lines are formed in the step of extracting after the step of determining.

10. The method according to claim 9, wherein the population number ratios are divided by a length of the predetermined time window to obtain a population density for each amplitude line.

11. The method according to claim 1, wherein a determination of the pitch is performed before the step of extracting.

12. The method according to claim 11, wherein the population density for each amplitude line of the plurality of amplitude lines is related to the pitch.

13. The method according to claim 8, wherein in the step of extracting at least one of a mean value of the amplitude values present in the predetermined time window is determined, a standard deviation of the amplitude values present in the predetermined time window is determined, a scattering of the amplitude values around the amplitude standard deviation is determined, wherein the identifier for the audio signal is based on at least one of the mean values, the standard deviations, and the scattering.

14. The method according to claim 1, wherein a discrete frequency-time representation is also produced, and wherein the identifier for the audio signal is further extracted from the frequency-time representation.

15. A method for building an instrument database, comprising the following steps:

providing an audio signal including a tone of a first one of a plurality of instruments;

generating a first identifier for the first audio signal according to claim 1;

providing a second audio signal including a tone of a second one of a plurality of instruments;

generating a second identifier for the second audio signal according to claim 1; and storing the first identifier as a first reference identifier and the second identifier as a second reference identifier in the instrument database in association to a reference to the first and second instruments, respectively.

16. The method according to claim 15, wherein a plurality of identifiers for a plurality of different tone are generated and stored for both the first and second instruments.

17. The method according to claim 16, wherein a respective identifier is generated and stored for each instrument in half tone steps from a lowest tone to a highest tone producible by this instrument.

18. The method according to claim 16, wherein identifiers for different tone lengths are generated and stored additionally for each tone of an instrument.

19. The method according to claim 15, wherein different identifiers are generated and stored for different techniques of playing an instrument.

20. A method for determining the type of an instrument from which a tone contained in a test audio signal comes, comprising the following steps:

generating a test identifier for the test audio signal according to claim 1;

comparing the test identifier to a plurality of reference identifiers in an instrument database, wherein the instrument database is generated according to claim 15; and establishing that the type of the instrument from which the tone contained in the test audio signal comes equals the type of the instrument to which a reference identifier which is similar to the test identifier as regards a predetermined criterion of similarity is associated.

21. A device for generating an identifier for an audio signal present as a sequence of samples and including a tone produced by an instrument, comprising:

means for generating a discrete amplitude-time representation of the audio signal by detecting signal edges in the sequence of samples, wherein an amplitude value indicating an amplitude of the detected signal edge and a time value indicating a point in time of an occurrence of the signal edge in the audio signal are associated to each detected signal edge, and wherein the amplitude-time representation has a sequence of subsequent signal edges detected; and means for extracting the identifier for the audio signal from the amplitude-time representation.

22. A device for building an instrument database, comprising:

means for providing an audio signal including a tone of a first one of a plurality of instruments;

means for generating a first identifier for the first audio signal according to claim 21;

means for providing a second audio signal including a tone of a second one of a plurality of instruments;

means for generating a second identifier for the second audio signal according to claim 21; and means for storing the first identifier as a first reference identifier and the second identifier as a second reference identifier in the instrument database in association to a reference to the first and second instruments, respectively.

23. A device for determining the type of an instrument from which a tone contained in a test audio signal comes, comprising:

means for generating a test identifier for the test audio signal according to claim 21;

means for comparing the test identifier to a plurality of reference identifiers in an instrument database, wherein the instrument database is formed according to claim 22; and means for establishing that the type of the instrument from which the tone contained in the test audio signal comes equals the type of the instrument to which a reference identifier which is similar to the test 10 identifier as regards the predetermined criterion of similarity is associated.

* * * * *